United States Patent [19]

Wilder et al.

[11] 4,043,806

[45] Aug. 23, 1977

[54] ALLOYS FROM MANGANESE NODULES

[75] Inventors: Thomas C. Wilder, Cambridge, Mass.; Walter E. Galin, Pawtucket, R.I.

[73] Assignee: Kennecott Copper Corporation, New York, N.Y.

[21] Appl. No.: 632,477

[22] Filed: Nov. 17, 1975

Related U.S. Application Data

[62] Division of Ser. No. 514,614, Oct. 15, 1974, Pat. No. 3,957,485.

[51] Int. Cl.[2] ..... C22C 39/54

[52] U.S. Cl. ..... 75/125; 75/122; 75/123 K; 75/123 N

[58] Field of Search ..... 75/125, 123 N, 123 K, 75/80, 122

[56] References Cited

PUBLICATIONS

Beck et al., Copper Metallurgy, Nov. 16, 1971, pp. 70–82 relied on.

*Primary Examiner*—M. J. Andrews

*Attorney, Agent, or Firm*—Anthony M. Lorusso; John L. Sniado

[57] ABSTRACT

A method of recovering metal values from deep sea manganese nodules. A liquid reductant such as bunker-C oil is utilized as a reducing agent.

As a result of the efficient contact between the liquid reducing agent and the nodules, little prior preparation of the nodules is required to recover a high percentage of copper, nickel, cobalt and molybdenum.

A new series of metal alloys are produced in the selective reduction of the nodules, the major phase being iron-rich nickel, one minor phase being 80-90% copper and the other minor phase being a combination of manganese, molybdenum, nickel, cobalt and iron.

8 Claims, 2 Drawing Figures

ALLOYS FROM MANGANESE NODULES

This is a division, of application Ser. No. 514,614 filed Oct. 15, 1974 now U.S. Pat. No. 3,957,485.

BACKGROUND OF THE INVENTION

The present invention is directed to the recovery of metal values from manganese deep sea nodules by smelting the nodules under reducing conditions.

A metal recovery process for manganese nodules which requires smelting has generally been downrated. The requirements of having to melt a large amount of material of which only four percent is a desired product is naturally unattractive. The difficult metals separation scheme required for the smelted alloy product is another minus factor.

Indeed, in recent years, much emphasis has been placed on perfecting hydrometallurgical processes for treating nodules to render the copper, nickel, cobalt and molybdenum values leachable. Nevertheless, the high extractions and fast reduction kinetics characteristic of most smelting processes dictate that such a route has certain advantages. In the case of nodules, other advantages of smelting over hydrometallurgical processing include:

1. Less steps in ore preparation
2. Elimination of a leaching step
3. No requirement for a tailings pond
4. A non-polluting waste product.

A reduction smelting process for deep-sea manganese nodules in which a solid reductant such as coke is utilized as the reducing agent is known. Details of that process are disclosed in Canadian Pat. No. 871,006 entitled "Smelting of Manganiferous Ore Material."

Furthermore, recent research on the reduction roasting of nodules with various carbonaceous reducing agents revealed that, as opposed to coal or gas, a liquid reducing agent such as a petroleum product produces calcines from which a significantly greater amount of the copper, nickel, and cobalt may be extracted by an ammoniacal leach. For details of such reduction roasting, see U.S. Pat. No. 3,753,686.

In the prior art solid reductant smelting process, an amount of a solid reducing material, typically between 2 percent to 5 percent, based on the dry weight of the ore material, is necessary to provide for selective reduction of the desired metals. Sufficient fluxing agent, e.g., limestone or silica, is added before or during the smelting operation to provide a fluid slag. Smelting times range from about 1 to about 4 hours. In that process, the reduction of cobalt and copper is enhanced by the addition of sulfur-bearing minerals, such as iron pyrites, in amounts ranging from about 1 to about 15 percent by weight; but, the addition of sulfur bearing materials also reduces a greater proportion or iron and manganese which is undesirable.

As a result of smelting with a solid reducing agent, a metal reduction product is formed which contains most of the desired metals, i.e. copper, nickel, cobalt and molybdenum, and some iron but very little manganese. The principal slag constituents are manganese oxides, iron oxides, and silica.

SUMMARY OF THE INVENTION

In accordance with the present invention, it has been discovered that a liquid reducing agent has several important and surprising advantages over solids or gases.

The most significant advantage is that liquid allows improved contact of the reducing agent with the finely disseminated metal values found in the nodules which results in a more complete reduction of desirable metals to the alloy phase and a more selective reduction of the desirable metals to the partial exclusion of the undesirable manganese and iron.

Another advantage is a cost saving in that the nodules may be smelted without prior preparation such as griding and sizing which is necessary when a solid reductant is used in the reduction.

Accordingly, an object of the invention is to provide a reduction smelting process for manganese nodules in which contact between the metal values in the nodules and the reductant is improved.

Another object of the invention is to effect the selective reduction of desirable metals from deep sea nodules to the partial exclusion of iron and manganese in the recovered alloy.

Another object of this invention is to eliminate the costly ore preparation step prior to smelting in a nodule reduction smelting process.

Still another object is to produce an alloy product from manganese nodules which is low in undesirable metals and which lends itself to an economical metal separation process.

Another object of the invention is to provide a reduction smelting process for manganese nodules in which a liquid is the reductant.

DESCRIPTION OF THE PREFERRED EMBODIMENTS

Figure 1:
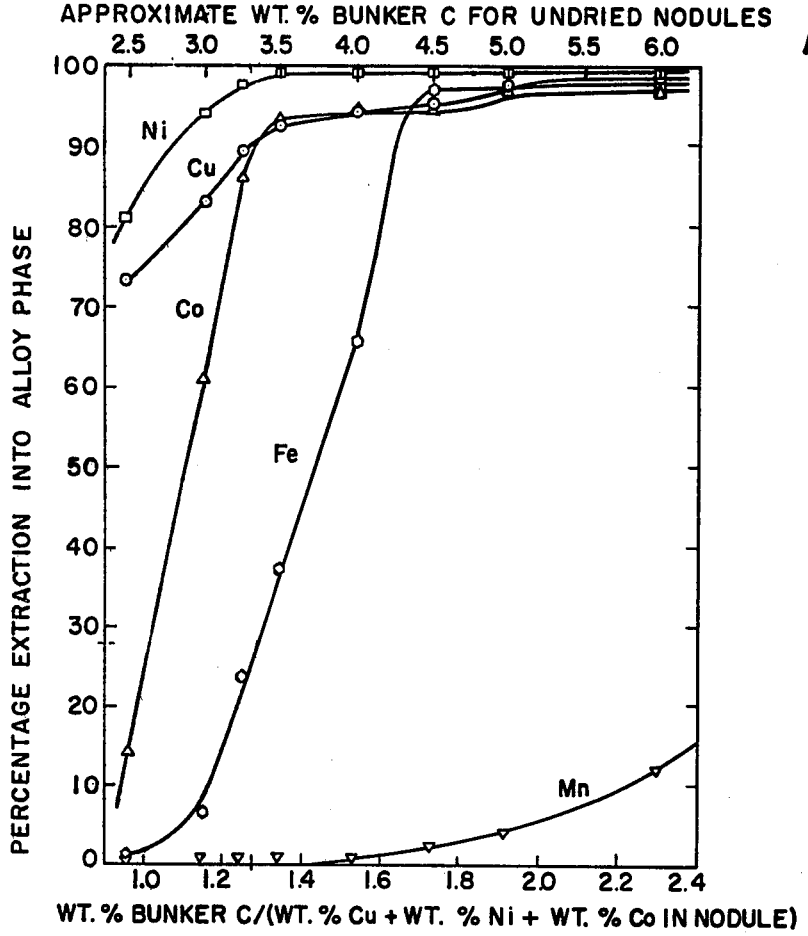
FIG. 1 is a graph showing extractions into the alloy phase as a function of the bunder C oil content in the charge, and, FIG. 2 is a graph showing the range of compositions for new alloys produced in accordance with the present invention.

The present invention relates to an economical and improved process for recovering metalic copper, nickel, molybdenum and cobalt from manganese deep sea nodules. For the purpose of this patent specification and claims, complex ores which are found on the deep sea floor of oceans and lakes containing manganese, iron, copper, nickel, molybdenum, cobalt and other metal values are variously referred to as deep sea manganese nodules, manganese nodules or nodules.

Ocean floor deposits are found as nodules, loose-lying at the surface of the soft sea floor sediment, as grains in the sea floor sediments, as crusts on ocean floor hard rock outcrops, as replacement fillings in calcareous debris and animal remains, and in other less important forms. Samples of this ore material can readily be recovered on the ocean floor by drag dredging, a method used by oceanographers for many years, or by deep sea hydraulic dredging, a method that could be used in commercial operations to mine these deposits. Mechanical deep sea nodule havesters are described in U.S. Pat. Nos. 3,480,326 and 3,504,943.

The character and chemical content of the deep sea nodules may vary widely depending upon the region from which the nodules are obtained. The Mineral Resources of the Sea, John L. Mero, Elsevier Oceanography Series, Elsevier Publishing Company, 1965, discusses on pages 127 - 241 various aspects of manganese nodules. For a detailed chemical analysis of nodules from the Pacific Ocean see pages 449 and 450 in The Encyclopedia of Oceanography, edited by R. W. Fairbridge, Reinhold Publishing Corp., N.Y. 1966, and U.S. Pat. No. 3,169,856. For the purpose of this invention, the complex ores will be considered as containing the following approximate metal content range on a dry basis:

| METAL CONTENT ANALYSIS RANGE | |
|---|---|
| Copper | 0.8 - 1.8% |
| Nickel | 1.0 - 2.0% |
| Cobalt | 0.1 - 0.5% |
| Molybdenum | 0.03 - 0.1% |
| Manganese | 10.0 - 40.0% |
| Iron | 4.0 - 25.0% |

The remainder of the ore consists of oxygen as oxides, clay minerals with lesser amounts of quartz, apatite, biotite, sodium and potassium feldspars and water of hydration. Of the many ingredients making up the manganese nodules, copper and nickel are emphasized because, from an economic standpoint, they are the most significant metals in most of the ocean floor ores.

At the outset, the process of the present invention is described in its broadest overall aspects with a more detailed description following.

In accordance with the present invention, a liquid reducing agent is utilized to reduce the desired metal compounds to their elemental state without removing significant quantities of manganese and iron from the nodules. For example, reduction smelting of manganese nodules with bunker C fuel oil gives extractions into an alloy phase which are considerably higher than typical extractions obtained by a roast-leach scheme. Over 90 percent of the copper, nickel, cobalt and molybdenum may be recovered with a 3.5% by weight addition of bunker C fuel oil as the liquid reducing agent while rejecting over three-quarters of the iron and essentially all of the manganese into a slag. If a greater amount of iron is reduced, practically 100% of the base metals are recovered while still rejecting the manganese. The addition of silica lowers the temperature where good reduction and phase separation takes place, and also ties up most of the manganese as the stable non-polluting silicate.

Overall extractions and rejection of iron and manganese are slightly better using bunker C compared to coke as the reductant. The advantage of using a liquid reductant such as bunker C oil because of the better contact between the liquid reducing agent and the finely disseminated metal values of the nodule.

As stated above, the liquid-solid contact between the fuel oil and the very porous nodules is more intimate than for other reductants. Furthermore, much of the reduction takes place at low temperatures where the reducing agent is still liquid. These assumptions are based on:

1. Similar results obtained using other liquid reducing agents, such as water soluble methyl cellulose.
2. Higher leach extractions from calcines roasted at low temperatures with bunker C oil as comwith coal.
3. The temperature-time traces of the reaction mixture during heat-up.

The intimate contact of the reducing agent looms important when considering a smelting process for a mineral such as nodules which contain many metals in macroscopic amounts. Of course, in addition to bunker C oil (or No. 6 fuel oil as it is sometimes called) other liquid reductants can be employed to great advantage in the process of the present invention. The reductants which can be employed in the present process include:

Crude oil and its fractions
Soluble carbohydrates (i.e. starches, sugars, etc.)
Molasses
Soluble celluloses
Alcohols, esters, ketones, ethers and aldehydes
Liquid aromatic and aliphatic hydrocarbons.

During the reduction of nodules, it can be assumed that the last stage prior to the metallic state is the lowest oxide stage since the metals are known to be associated with oxygen. The standard molar free energies of reduction suggests a way is possible in which to selectively recover metallic copper, nickel, cobalt and molybdenum as they are apparently the easiest to reduce.

TABLE 1

Standard Molar Free Energies of Reduction of Oxides in Nodules

| Reduction Reaction | | ΔF° at 1500° K(cal) |
|---|---|---|
| $Cu_2O + C$ | $= 2\,Cu + CO$ | −45,020 |
| $NiO + C$ | $= Ni + CO$ | −32,190 |
| $CoO + C$ | $= Co + CO$ | −27,320 |
| "FeO" + C | $= Fe + CO$ | −18,220 |
| $MnO + C$ | $= Mn + CO$ | + 7,230 |

Unfortunately, total selectivity cannot be achieved. This is seen in the actual free energy change as the reduction proceeds. For example, in the cobalt reduction reaction:

$$CoO + C = Co + CO \qquad \Delta F^\circ = -27{,}320 \text{ at } 1500^\circ\text{ K}$$

The actual free energy change is:

$$\Delta F = \Delta F^\circ + RT \ln K \tag{1}$$

$$= -27{,}320 + 2981 \ln\left(\frac{a_{Co}}{a_{CoO}}\,\frac{P_{CO}}{a_C}\right) \tag{2}$$

where $a$ = activity $p$ = partial pressure

As cobalt oxide (CoO) is reduced to cobalt, the cobalt activity in the alloy increases and the cobalt oxide in the slag decreases until the point at which the second factor in Eq (2), i.e. 2981 ln $(a_{Co}\,P_{CO}/a_{CoO}\,a_C)$, is sufficiently great that ΔF is increased (becomes less negative) to the value at which some iron is reduced. If overall concentration of cobalt in the starting material is 0.3%, the partial pressure of carbon monoxide is 0.15 atm, the activity of carbon is unity, and the activities of cobalt in the alloy and cobalt oxide in the slag are approximately equal to their concentrations, Eq (2) increases to a value where substantial iron will be reduced when 88% of the cobalt has been reduced. If the activity of CoO in the slag is one-tenth of its concentration, then only 32% by weight of the cobalt will be reduced at this point. Since the cobalt in nodules is dilute with respct to iron, the amount of CoO remaining in the slag, when the thermodynamics are favorable for iron reduction, is a substantial portion of the total cobalt present.

A similar argument may be made to explain the impossibility of complete separation of any two metals in such a system. Generally, the unfavorability for separation becomes greater as the standard free energies of reduction, such as those in Table 1, become closer, or if the metal to be reduced is very dilute as compared with the unwanted metal.

Although complete separation of metals is not possible, the best separation can be achieved using a liquid reducing agent which is in closer contact (compared with a solid) with the widely disseminated metal values.

In addition to allowing selective reduction, the liquid also enables the smelting process to go forward without any prior preparation of the ore. Drying of the nodules may be desirable but is not necessary to obtain the benefits of this invention. Pelletizing may also adapt this invention for use in a blast furnace; although again, pelletizing is not necessary to gain the benefit of the invention.

Finally, the addition of a fluxing agent such as silica is beneficial in depressing the temperature at which good reduction and phase separation occur so that lower smelting temperatures may be employed. A 10% silicon dioxide addition gives approximately the lowest melting eutectic in the $MnO—SiO_2$ system and in addition, ties up substantially all the manganese as a manganese silicate, $Mn_2SiO_4$. $Mn_2SiO_4$ is a very stable compound which would not be a pollution threat for the disposed slag from the process. The overall steps for the process are as follows:

The nodules as received are crushed to a size suitable for handling (e.g. minus ¼ in.) and are mixed with a siliceous material (i.e. sand) in an amount equal to 10% of their weight and a liquid reducing agent (preferably crude oil or a heavy fraction of crude oil), the amount of which is determined from the percentage of nickel, copper and cobalt in the nodules which can be determined from chemical analysis. The liquid reducing agent will naturally be absorbed by the nodules so that there is no need to further mix, blend, stir or otherwise insure good contact between ore and reductant. The mixture is then charged to an electric furnace, or any other type of furnace where heat is generated without introduction of another reducing agent. The temperature is held above 1250° C (2282° F) and preferably below 1350° C (2462° F). The liquid alloy which is formed is continuously withdrawn from the bottom of the furnace. The slag, chiefly manganese silicate, is continuously tapped from the side of the furnace preferably the side away from where the feed is charged. The present invention is further illustrated by the following non-limiting examples. As used throughout this specification the percentages are weight percentages unless otherwise stated.

EXAMPLE I

Ground undried nodules were mixed with 3.5% bunker C fuel oil and 10% silica. So that the amount of bunker C added does not depend on the water content of the nodules, it is better to express the amounts as % bunker, C/(% Cu + % Ni + % Co.) On this basis, the ratio of bunker C to metal was 1.35.

The metal content of the nodules was about 1.10% Cu, 1.28% Ni and 0.23% Co. About 260 grams of the mixture was held in an alumina crucible and smelted at 1350° C. Excellent separation of the metallic reduction phase and the slag phase was obtained. The alloy was then analyzed for composition to determine the extent of metal extraction from the nodules and the extent of impurities. The result was as follows:

| Percentage Extraction Into Alloy Phase | | | | | |
|---|---|---|---|---|---|
| Cu | Ni | Co | Mo | Fe | Mn |
| 92.7 | 99.0 | 93.5 | 92.0 | 37.5 | 0.047 |

EXAMPLE II

Undried manganese nodules were ground to minus 60 mesh and mixed with 4.5% bunker C fuel oil and 10% silica based on the weight of the nodules. The silica addition was calculated to be that required to approximate the eutectic composition of the $MnO—SiO_2$ system. About 200 grams of material was placed in an alumina crucible and slowly taken to 1250° C in a vertical tube furnace under an argon atmosphere. Heat-up time was 4 hours and soak time was 1–2 hours. The mixture was allowed to furnace cool.

Percentage extraction of the metals was determined from the slag adjacent to the metal phase and in the slag at some distance from the metal slag interface.

| | Percentage Extraction From Nodules | | | |
|---|---|---|---|---|
| Determined from: | Cu | Ni | Co | Mo |
| Slag adjacent to metal | 93.5 | 99.5 | 93.0 | 98.0 |
| Slag distant from metal | 97.3 | 99.6 | 96.8 | 98.0 |

In some cases a materials balance was performed on the final metal values in the alloy and slag, and compared with the average concentrations in the starting material. In these tests, less than one percent of the base metals is lost to the vapor phase at the smelting temperatures. This would indicate that metal loss by a chlorination reaction with sea water contained in the nodules is minor.

Assuming that there is no loss of $SiO_2$ and that all of the bunker C ends up as gaseous products, the average weight loss of the nodules on smelting at 1250° C is 35%.

A summary of extractions into the metal phase as a function of the amount of bunker C in the feed is given in Table II. This information is also presented in graphical form in FIG. 1. It is interesting to note that the relative reducibility of the metals follows the trend suggested thermodynamically by Table I with the exception of nickel and copper. Copper extraction falls slightly behind nickel in all cases. Copper is probably more soluble in the slag so that its activity in the slag is diminished relative to nickel at the same concentration. In two samples, the slag adjacent to the alloy and that away from the alloy near the surface was analyzed, giving essentially the same results.

TABLE II

Percentage Extraction of Metals into Alloy Phase for Smelting of Nodules at 1250–1350° C with bunker C Fuel Oil

| Wt. Pct. of bunker C | Percentage Extraction into Alloy Phase | | | | | |
|---|---|---|---|---|---|---|
| in Undried Feed | Cu | Ni | Co | Mo | Fe | Mn |
| 2.5 | 73.4 | 81.1 | 14.2 | 0.5 | 1.2 | 0.005 |
| 3.0 | 83.1 | 94.1 | 60.9 | 9.8 | 6.8 | 0.017 |
| 3.25 | 89.5 | 97.6 | 86.2 | 80.1 | 23.8 | 0.020 |
| 3.5 | 92.7 | 99.0 | 93.5 | 92.0 | 37.5 | 0.047 |
| 4.0 | 94.4 | 99.2 | 94.1 | 97.9 | 65.5 | 0.11 |
| 4.5 | 95.4 | 99.5 | 94.9 | 98.0 | 97.2 | 2.30 |
| 5.0 | 97.8 | 99.0 | 97.7 | 98.0 | 97.9 | 3.86 |
| 6.0 | 98.7 | 99.1 | 96.2 | 97.4 | 97.9 | 12.0 |

As is shown in TABLE II, acceptable extractions of desired metals occur with as little as 2.5% bunker C oil.

With 6.0 wt. percent bunker C oil, unwanted manganese extractions become appreciable. Therefore, the operable range of bunker C oil is 2.5–6.0 wt. % of nodule feed.

From an economic standpoint, it is preferred to extract at least 90% of the desired metals, so that an addition of at least 3.5% bunker C fuel is necessary. The preferred range of bunker C oil is 3.5–4.5% of the nodule feed. Even with 90% recovery of the valuable metals, only 0.047% of the Mn impurity is extracted while less than 40% of the iron is extracted to the alloy.

Although the proper amount of bunker C oil can be determined from the total weight of the nodules, it is preferred to determine the proper amount of bunker C oil from the combined weight percent of copper, nickel and cobalt in the nodules.

In accordance with the present invention, the preferred weight percent bunker C oil in the charge is equal to 1.35 to 1.72 time the combined weight percent of copper plus nickel plus cobalt in the nodules. This can be expressed as follows:

$$\frac{\text{Wt\% bunker C}}{\text{Wt\% (Ni + Cu + Co)}} = 1.35 \text{ to } 1.72$$

Operable results occur when the ratio of the weight percent of bunker C divided by the weight percent of copper plus nickel plus cobalt is in the range of .95 to 2.30.

With regard to reduction temperature, the lower end of the temperature range is 1250° C. The upper limit is determined by economic considerations. In this regard there is no advantage to be gained by reducing at temperatures above 1500° C. In accordance with the present invention, the preferred temperature range during reduction is 1300°–1400° C with optimum reduction occurring at about 1350° C. The foregoing temperatures are for a charge containing 10% by weight silica $SiO_2$. Without the added silica, it is necessary to heat the charge to a temperature of 1400° C to melt the nodules.

Figure 2:
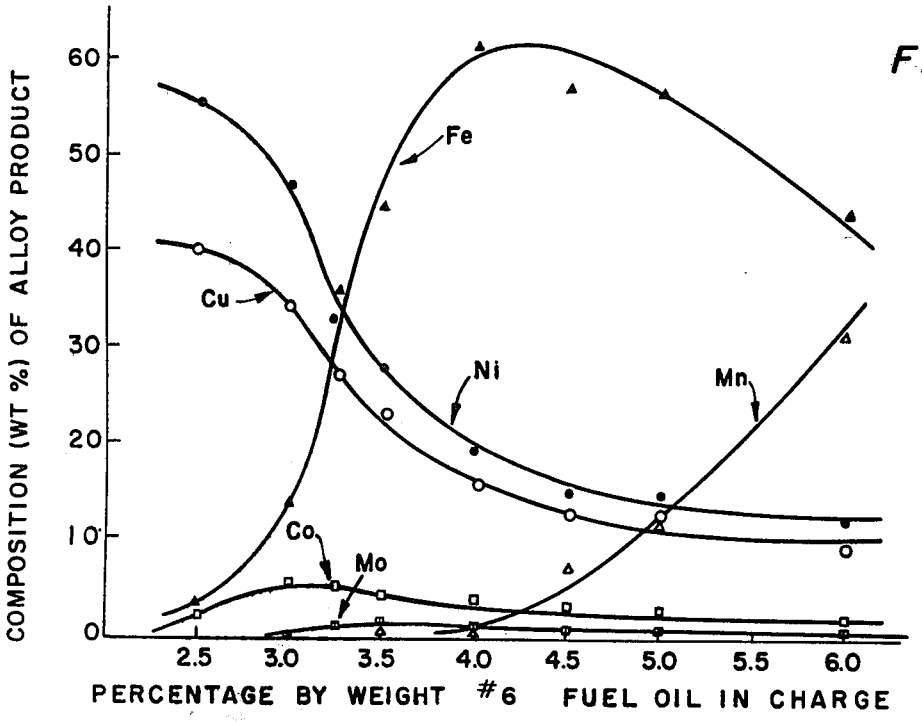

A new series of alloys is obtained by the use of a liquid as a reductant in a smelting process. The alloy which is formed may have a wide range of compositions, as seen from FIG. 2.

The overall composition of the alloy phase which corresponds to the extractions of Table II are shown in Table III.

obtain greater than 90% extractions of copper, nickel, and cobalt into the alloy phase, at least a quarter to a third of the iron must also be reduced, resulting in an alloy which will contain 40 to 50 percent by weight of iron. The exclusion of manganese from the alloy phase is exceptionally good.

The composition of the cooled alloy phase is referred to as "overall" because it actually is composed of several immiscible phases of different composition. The prime reason for the multiphased alloy is the presence of copper, which, except for nickel, does not form solid solutions of extensive composition range with any of the other metals present. Examination of several of the alloys representing good extractions were made by the electron microprobe. The major phase in all of the alloys is an iron-rich phase which also contains most of the nickel and cobalt. The second phase is copper-rich, and usually contains 80–90% Cu, remainder nickel, and a little iron. A third phase was also observed which is Fe—Ni—Mn—Mo—Co and contains most of the molybdenum and practically no copper. Finally, small inclusions of MnS were also seen in all alloys. The relative amounts of each phase present is, of course, dependent upon overall composition. The composition of each phase is dependent on cooling rate, as well as on the amount of iron and manganese reduced. The alloy is completely homogeneous when molten.

The preferred alloy from a metals separation viewpoint, is where nickel, copper and cobalt are at least 90% extracted, but where iron is less than 40% extracted and manganese is less than 0.1% extracted.

The alloy series made by the process described above will contain the following:

| | |
|---|---|
| Copper | 10 - 40 weight percent |
| Nickel | 12 - 55 weight percent |
| Cobalt | 1.6 - 5.3 weight percent |
| Molybdenum | 0.02 - 1.3 weight percent |
| Iron | 3.3 - 61 weight percent |
| Manganese | 0.07 - 31.1 weight percent. |

As stated above, the preferred alloy is produced when the weight percent bunker C oil in the charge is equal to 1.35 to 1.72 times the weight percent of copper plus nickel plus cobalt.

This results in an alloy having the following composition:

TABLE III

Composition of Alloy Phases Produced by Smelting of Nodules with Bunker C

| | Wt.Pct. of Bunker in Undried Feed | Wt.% Bunker C / Wt.% Cu+ wt.% Ni+ wt.% Co in Nodule | Overall Composition of Alloy (Wt. pct.) Cu | Ni | Co | Mo | Fe | Mn |
|---|---|---|---|---|---|---|---|---|
| | 2.5 | .95 | 40.0 | 55.2 | 1.68 | 0.02 | 3.38 | 0.07 |
| | 3.0 | 1.14 | 34.3 | 46.7 | 5.29 | 0.23 | 13.8 | 0.17 |
| | 3.25 | 1.24 | 26.8 | 32.8 | 4.97 | 1.28 | 35.3 | 0.17 |
| | 3.5 | 1.35 | 22.9 | 27.7 | 4.25 | 1.23 | 44.3 | 0.29 |
| Preferred Range | 4.0 | 1.53 | 15.3 | 19.1 | 3.23 | 0.95 | 61.1 | 0.37 |
| | 4.5 | 1.72 | 12.5 | 15.0 | 2.55 | 0.74 | 56.9 | 7.16 |
| | 5.0 | 1.91 | 12.2 | 14.3 | 2.35 | 0.69 | 56.4 | 11.3 |
| | 6.0 | 2.30 | 9.6 | 12.1 | 1.60 | 0.59 | 43.7 | 31.1 |

Iron is the major component of all the alloys produced when over 3.5% bunker c oil is utilized which represents good extractions because its concentration in nodules is much greater than the desired metals. In order to

| | |
|---|---|
| Copper | 12.50 - 22.90 wt. % |
| Nickel | 15.00 - 27.70 wt. % |

-continued

| | |
|---|---|
| Cobalt | 2.55 - 4.25 wt. % |
| Molybdenum | 0.74 - 1.23 wt. % |
| Iron | 44.30 - 56.90 wt. % |
| Manganese | 0.29 - 7.16 wt. % |

If desired, the alloy of the present invention can be further refined by separating the various components of the alloy. For example, the alloy may be solidified under conditions to produce small particles. The particulate alloy is then dissolved in an aqueous ammoniacal ammonium carbonate solution containing 100 grams per liter ammonia and 25 grams per liter $CO_2$ as carbonate. The solution dissolves the copper, nickel and cobalt as complex amines. The molybdenum would also dissolve as a molybdate. The iron precipitates as a hydroxide and the manganese precipitates as a carbonate. The copper, nickel, cobalt and molybdenum can then be recovered by a liquid ion exchange solvent extraction process.

In the liquid ion exchange separation process the object is to separate the copper, nickel, cobalt and molybdenum from each other and from the pregnant liquor. Initially, the copper and nickel are co-extracted by an organic extractant in a series of mixer/settler units. The organic extractant is LIX-64N in a kerosene base. LIX-64N is an extractant sold by General Mills Chemicals, Inc.

The copper and nickel free liquor (raffinate) is sent to a storage tank before it is steam stripped.

The organic extractant which contains copper and nickel values is washed with an $NH_4HCO_3$ solution followed by an ammonium sulfate solution to remove ammonia picked up during extraction. This scrubbing operation is carried out in another series of mixer settlers. The organic extractant is then stripped with a weak $H_2SO_4$ solution (pH about 3) to preferentially remove nickel. Thereafter, the copper is stripped, which is accomplished by using a stronger (160 g/l) $H_2SO_4$ solution. The copper and nickel free organic extractant is recycled.

The raffinate contains only cobalt, molybdenum and some trace impurities that were not extracted into the organic phase. In the cobalt and molybdenum recovery circuit, the ammonia and $CO_2$ are stripped from the raffinate thereby precipitating cobalt. The ammonia and $CO_2$ are condensed and sent back to the process for recycling. The cobalt precipitate is separated from the liquor and the liquor is subsequently treated with hydrated lime to precipitate the molybdenum. For further details of a liquid ion exchange procedure which can be employed, see U.S. application Ser. No. 266,985 entitled Selective Stripping Process by Roald R. Skarbo, filed June 28, 1972, the teachings of which are incorporated herein by reference.

A comparison of the present invention with the prior art is shown in Table IV below.

TABLE IV

Summary of Extractions from Nodules by Smelting with Coke and Bunker C Fuel Oil

| Reducing Agent and Amount | Other Additives | Reduction Temp ° C | Percentage Extraction into Alloy Phase | | | | | |
|---|---|---|---|---|---|---|---|---|
| | | | Cu | Ni | Co | Mo | Fe | Mn |
| 5% coke | None | 1450 | 86.7 | 85.5 | 45.3 | 88.0 | 38.2 | 0.25 |
| 5% coke | 5% $SiO_2$ | 1400 | 93.3 | 94.8 | 65.8 | 91.2 | 72.0 | 0.31 |
| 5% coke | 5% $SiO_2$ 5% $FeS_2$ | 1440 | 87.2 | 96.4 | 92.1 | 89.3 | 84.7 | 3.48 |
| 5% coke | 5% $SiO_2$ 15% $Fes_2$ | 1450 | 90.7 | 97.0 | 100.0 | 74.2 | 88.9 | 6.83 |
| 3.8% coke | | 1425 | 81.6 | 98.4 | 93.2 | 93.0 | 22.6 | 0.16 |
| 5% bunker C | 10% $SiO_2$ | 1250 | 97.8 | 99.0 | 97.7 | 98.0 | 97.9 | 3.86 |
| 4% bunker C | 10% $SiO_2$ | 1250 | 94.4 | 99.2 | 94.1 | 97.9 | 65.5 | 0.11 |
| 3.5% bunker C | 10% $SiO_2$ | 1350 | 92.7 | 99.0 | 93.5 | 92.0 | 37.5 | 0.05 |
| 3% bunker C | 10% $SiO_2$ | 1350 | 83.1 | 94.1 | 60.9 | 9.8 | 6.8 | 0.02 |

Thus, reduction smelting of manganese nodules with bunker C fuel oil yields greater than 90% extractions of copper, nickel, cobalt, and molybdenum into an alloy phase which contains less than a third of the iron and practically none of the manganese originally in the nodule. If more iron is reduced, close to 100% of the base metals may be extracted. Overall base metal extraction and selectivity of reduction is slightly better than when using coke as the reducing agent in a smelting scheme. The improved selectivity and extractions using liquid reductants is a result of the better contact between the liquid reducing agent and the finely disseminated metal values of the mineral.

In the foregoing examples, detailed results of the use of bunker C oil are disclosed. Of course, as is stated above, reductants other than bunker C oil can be used. Of course, with reductants with carbon and hydrogen contents different from that of bunker C oil, the ratio of the weight percent of the reductant in the charge to the weight percent of copper plus nickel plus cobalt would vary from the values disclosed. The variation of this ratio would be proportional to the variation of the carbon and hydrogen content of the reductant as compared to bunker C oil. Thus, the invention may be embodied in other specific forms without departing from the spirit or essential characteristics thereof. The present embodiments are therefore to be considered in all respects as not restrictive, the scope of the invention being indicated by the appended claims rather than by the foregoing description, and all changes which come within the meaning and range of equivalency of the claims are therefore intended to be embraced therein.

We claim:

1. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 22.9 % |
| Nickel | 27.7 % |
| Cobalt | 4.25 % |
| Molybdenum | 1.23 % |
| Iron | 44.3 % |
| Manganese | Balance |

2. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 15.3% |
| Nickel | 19.1% |
| Cobalt | 3.23% |
| Molybdenum | 0.95% |
| Iron | 61.1% |
| Managnese | Balance. |

3. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 12.5% |
| Nickel | 15.0% |
| Cobalt | 2.55% |
| Molybdenum | 0.74% |
| Iron | 56.7% |
| Manganese | Balance. |

4. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 40.0% |
| Nickel | 55.2% |
| Cobalt | 1.68% |
| Molybdenum | 0.02% |
| Iron | 3.38% |
| Manganese | Balance. |

5. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 34.3% |
| Nickel | 46.7% |
| Cobalt | 5.29% |
| Molybdenum | 0.23% |
| Iron | 13.8% |
| Manganese | Balance. |

6. An alloy composed of several immiscible phases, a major phase being an iron-rich nickel phase, one minor phase containing 80–90% copper and another minor phase being a combination of manganese, molybdenum, nickel, cobalt and iron the overall composition of the alloy having the following constituents in percent by weight:

| | |
|---|---|
| Copper | 26.8% |
| Nickel | 32.8% |
| Cobalt | 4.97% |
| Molybdenum | 1.28% |
| Iron | 35.3% |
| Manganese | Balance. |

7. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 12.2% |
| Nickel | 14.3% |
| Cobalt | 2.35% |
| Molybdenum | 0.69% |
| Iron | 56.4% |
| Manganese | Balance |

8. An alloy composed of several immiscible phases, a major phase being an iron-rich nickel phase, one minor phase containing 80–90% copper and another minor phase being a combination of manganese, molybdenum, nickel, cobalt and iron, the overall composition of the alloy having the following constituents in percent by weight:

| | |
|---|---|
| Copper | 9.6% |
| Nickel | 12.1% |
| Cobalt | 1.60% |
| Molybdenum | 0.59% |
| Iron | 43.7% |
| Manganese | Balance. |

* * * * *